US010414623B2

(12) United States Patent
Pohn et al.

(10) Patent No.: US 10,414,623 B2
(45) Date of Patent: Sep. 17, 2019

(54) METHOD FOR OPERATING A TEXTILE MACHINE WITH WORK STATIONS HAVING THEIR OWN HANDLING ELEMENTS FOR PIECING OF A THREAD, AND A TEXTILE MACHINE WITH OWN WORK STATIONS HAVING THEIR OWN HANDLING ELEMENTS

(71) Applicant: Rieter Ingolstadt GmbH, Ingolstadt (DE)

(72) Inventors: Romeo Pohn, Geisenfeld/Rottenegg (DE); Adalbert Stephan, Beilngries/Paulushofen (DE); Gerd Stahlecker, Eislingen/Fils (DE); Gernot Schaeffler, Waeschenbeuren (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 486 days.

(21) Appl. No.: 15/171,066

(22) Filed: Jun. 2, 2016

(65) Prior Publication Data

US 2016/0355954 A1 Dec. 8, 2016

(30) Foreign Application Priority Data

Jun. 2, 2015 (DE) ..... 10 2015 108 740

(51) Int. Cl.
*B65H 51/20* (2006.01)
*B65H 54/26* (2006.01)
(Continued)

(52) U.S. Cl.
CPC ..... *B65H 51/205* (2013.01); *B65H 54/26* (2013.01); *B65H 67/085* (2013.01); *D01H 4/48* (2013.01);
(Continued)

(58) Field of Classification Search
CPC ..... B65H 1/205; B65H 54/26; B65H 67/085; B65H 51/205; D01H 15/013
See application file for complete search history.

(56) References Cited

U.S. PATENT DOCUMENTS 4,041,684 A 8/1977 Kamp
4,501,116 A 2/1985 Schuller et al.
(Continued)

FOREIGN PATENT DOCUMENTS

DE 25 41 589 A1 3/1977
DE 25 54 053 A1 6/1977
(Continued)

OTHER PUBLICATIONS

Machine translation of EP 1970475 A2.*
EP Search Report, dated Sep. 23, 2016.
German Patent Office Search Report, dated Mar. 7, 2016.

*Primary Examiner* — Shaun R Hurley
(74) *Attorney, Agent, or Firm* — Dority & Manning, P.A.

(57) ABSTRACT

A method is provided for operating a textile machine, with a multiple number of adjacent work stations having a respective spinning unit with a spinning device and/or one winding device and handling elements for piecing a thread or for connecting two thread ends. If production is interrupted, a thread end on the bobbin side is provided to a defined receiving position at the work station. For piecing the thread or for connecting the thread ends, the thread end on the bobbin is cut to length by the work station work elements, received from the receiving position, prepared for piecing or for connecting and pieced up or connected. A thread end wound on the bobbin is sought out by means of a thread seeking device deliverable to multiple work stations of the textile machine, and the thread end is subsequently moved into the receiving position at the work station, from which it is received by the work station work element of the
(Continued)

work station, in particular by a handling element of its own work station. A corresponding textile machine is also provided.

9 Claims, 3 Drawing Sheets

(51) Int. Cl.
*D01H 15/013* (2006.01)
*B65H 67/08* (2006.01)
*D01H 4/48* (2006.01)

(52) U.S. Cl.
CPC ..... *D01H 15/013* (2013.01); *B65H 2701/31* (2013.01)

(56) References Cited

U.S. PATENT DOCUMENTS 4,628,684 A * 12/1986 Morita ..... D01H 4/50 57/263
5,022,222 A 6/1991 Rupert et al.
5,119,996 A * 6/1992 Stahlecker ..... D01H 15/013 242/472.8
5,313,775 A * 5/1994 Binder ..... B65H 54/026 57/261
5,778,651 A * 7/1998 Spindler ..... D01H 4/50 57/263
5,927,061 A 7/1999 Greis
6,662,542 B2 * 12/2003 Stephan ..... B65H 51/205 57/22
6,666,012 B2 * 12/2003 Widner ..... B65H 54/70 57/22
8,931,249 B2 1/2015 Stephan et al.
2002/0023422 A1 * 2/2002 Stephan ..... B65H 51/205 57/400
2003/0038206 A1 2/2003 Grecksch et al.

FOREIGN PATENT DOCUMENTS

DE 34 16 804 A1 11/1984
DE 196 34 300 A1 2/1998
DE 198 27 605 A1 12/1999
DE 101 37 081 A1 2/2003
DE 10 2011 053 811 A1 3/2013
EP 0 069 205 A1 1/1983
EP 0 311 987 A1 4/1989
EP 1 283 288 A2 2/2003
EP 1 970 475 A2 9/2008

* cited by examiner

METHOD FOR OPERATING A TEXTILE MACHINE WITH WORK STATIONS HAVING THEIR OWN HANDLING ELEMENTS FOR PIECING OF A THREAD, AND A TEXTILE MACHINE WITH OWN WORK STATIONS HAVING THEIR OWN HANDLING ELEMENTS

FIELD OF THE INVENTION

The present invention relates to a method for operating a textile machine with a multiple number of work stations arranged next to each other, whereas the work stations, as work elements, feature at least one spinning unit for producing a thread and/or one winding device for winding a thread onto a bobbin.

Furthermore, the work stations feature their own handling elements for the piecing of the thread or for connecting two thread ends. With the method, if production is interrupted, a thread end on the bobbin side is provided in a defined receiving position at the work station. For the piecing of a thread or for connecting two thread ends, the thread end on the bobbin side is cut to length by the work elements of the work station, in particular the handling elements, received from the receiving position, cut to length, prepared for the piecing process and pieced up or connected to the other thread end.

Furthermore, the invention relates to a textile machine with a multiple number of work stations arranged next to each other in a longitudinal direction of the textile machine, which, as work elements, feature at least one spinning unit for producing a thread and/or one winding device for winding the thread on a bobbin. In addition, the work stations feature their own multiple handling elements for the piecing of the thread or for connecting two thread ends. By means of the work elements, in particular the handling elements, a thread end on the bobbin side can be received, cut to length, prepared for piecing and pieced up or connected to the other thread end.

BACKGROUND

For conducting a piecing process after an interruption in production or the spinning process, various methods and devices are known in the state of the art. Thus, with many textile machines, it is customary that they are equipped with maintenance devices, movable along the work stations, which carry out all maintenance operations on the spinning units, such as the repair of thread breakages, bobbin changing, rotor cleaning, starting spinning with an empty tube, and the like. For this purpose, the maintenance devices feature a highly complex structure with a variety of different handling elements. Such a spinning machine with a movable maintenance device is described, for example, in DE 198 27 605 A1. However, in the case of multiple spinning units that require maintenance at the same time, considerable delays in the maintenance device may arise. The problem of waiting times is exacerbated by today's increasing trend of textile machines with more and more spinning units.

In order to reduce the waiting times on a movable maintenance device, it has also been known to provide multiple maintenance devices on each side of a spinning machine. DE 101 37 081 A1 describes such a spinning machine. For such machines with multiple maintenance devices, laborious processes for controlling the travel movement of the maintenance devices and the assignment of the individual work stations to the various maintenance devices are required. Nevertheless, when there are multiple spinning units that require maintenance at the same time, waiting times at the maintenance device and thus production losses arise, which reduces the efficiency of the machine.

Therefore, EP 1 283 288 B1 proposes a different approach for maintaining the work stations, with which all handling elements for the piecing of a thread, and possibly additional maintenance elements, are arranged directly at each work station. For this purpose, the work stations of the spinning machine feature individual drives controllable in a defined way, in order to, in a suitable manner, drive the work elements of the spinning unit according to the requirements, both during piecing and upon regular spinning operations. Thus, after production is interrupted, each work station is able to independently piece up the thread. In doing so, the problem of waiting times and the associated loss of production can be avoided. However, such a machine equipped with individual station automation is relatively expensive. In addition, due to the variety of the components to be arranged for each work station, the construction cost is high.

In order to avoid a time-consuming seeking out of a thread end wound on the bobbin and simplify the piecing process, it was further proposed by DE 10 2011 053 811 A1 to, in the event of a foreseeable interruption of the spinning process, shut down the work elements of the individual work stations in a controlled manner. Herein, the conveying speeds of the individual work elements of the spinning machine is reduced to a standstill in a controlled manner, such that a controlled thread breakage arises. Herein, the thread end does not wind on the bobbin; rather, it remains in a defined placing position in the thread path. From there, it can be received directly through handling elements of a movable maintenance device or through handling elements of their own work station and fed to the piecing process.

SUMMARY OF THE INVENTION

A task of the present invention is to propose a method and textile machine, by means of which, even in the event of unforeseen interruptions in production, the thread end can be rapidly supplied to the piecing process. Additional objects and advantages of the invention will be set forth in part in the following description, or may be obvious from the description, or may be learned through practice of the invention.

The tasks are solved with the characteristics of the methods and machines described herein.

With one method for operating a textile machine with a multiple number of work stations arranged next to each other arranged in a longitudinal direction of the textile machine, the work stations, as work elements, feature at least one spinning unit with one spinning device for producing the thread and/or one winding device for winding the thread on a bobbin. In addition, the work stations feature their own respective handling elements for the piecing of the thread or for connecting the thread ends. In the event that production is interrupted, a thread end on the bobbin side is provided in a defined receiving position at the work station. For the piecing of a thread, the thread end on the bobbin side is cut to length by the work elements of the work station, in particular the handling elements, received from the receiving position, prepared for the piecing and pieced up.

In the event of a winding-on of the thread end on the bobbin, it is now provided that a thread end wound on the bobbin is sought out by means of a thread seeking device on the surface of the bobbin movable in the area of multiple work stations of the textile machine, and the thread end is subsequently moved into the receiving position at the work station. In the receiving position, the thread end is finally received by a work element of the work station, in particular a handling element of the work station, and is fed to the piecing process.

A textile machine features a multiple number of work stations arranged next to each other in a longitudinal direction of the textile machine. Each of the work stations includes, as a work element, at least one spinning unit with one spinning device for producing a thread and/or one winding device for winding the thread on a bobbin, and in both cases, its own multiple handling elements for a piecing of the thread. By means of the work elements, in particular the handling elements of the work station, a thread end on the bobbin side is received from a defined receiving position, cut to length, prepared for piecing and pieced up or connected to the second thread end.

The textile machine features at least one thread seeking device movable in the area of multiple work stations of the textile machine, which features a suction nozzle subjected to negative pressure for seeking out a thread end wound on the bobbin. Furthermore, a transfer element is provided for moving the thread end from the suction nozzle to the receiving position at the work station, from which the thread end is receivable by a work element, in particular a handling element of its own work station.

With the described method or the described textile machine, it is possible that work stations are to be equipped to be largely self-sufficient, such that, in most cases, they are able to carry out the piecing process or the connecting process, for example the splicing process, independently and without waiting times. Since, when production is interrupted, the thread end is always provided in the defined receiving position, from which it can be acquired directly by work elements of the work station, a thread seeking device for each work station is unnecessary. This results in a significant cost advantage compared to a complete individual station automation along with a simplified design of the individual work stations, since a space-intensive thread seeking device need not be accommodated therein. Nevertheless, in the case of a thread end wound on the bobbin, it is possible that it is rapidly sought out by means of the movable thread seeking device deliverable to multiple work stations and fed to the piecing. Since the thread seeking device movable back and forth between multiple work stations is reduced to only one or two functions, namely thread seeking and (if applicable) the transfer to the spinning unit, considerable cost advantages compared to a traditional maintenance device and complete individual station automation arise. In addition, even if a thread breakage must be repaired at multiple work stations at the same time, the waiting times for the thread seeking device are considerably reduced, since it only needs to seek out the thread and transfer it to the spinning unit. Thus, the next work station can be operated significantly more rapidly.

According to a particularly advantageous design of the method, the thread end is moved by means of a transfer element of the thread seeking device into the receiving position at the work station. With the textile machine, at least one transfer element is accordingly arranged on the thread seeking device. In this case, the thread seeking device, as a work element, includes only one suction nozzle, one transfer element, and possibly even one thread cutting device. The transfer element may be designed, for example, as a swivel arm, movable hook, a linearly movable or crank-guided feeder arm or as a pneumatic transfer element. Thus, the thread end can be transferred by the thread seeking device directly to the work station or the work elements of the work station. In principle, however, it is also conceivable to arrange a transfer element at the work station, which then acquires the thread end from the suction nozzle and transfers it to the receiving position.

With a spinning machine, the receiving position, from which the thread end is received by a work element, in particular a handling element of its own work station, is preferably located in the thread path between an output of the spinning unit and the winding device, in particular between the output of the spinning unit and a draw-off device of the spinning unit. This area of the work station is easily accessible, such that the thread end can be easily transferred by the thread seeking device or the transfer element into this receiving position.

In order to, in the event of a predictable interruption in production, provide the thread end on the bobbin side in the receiving position, it is also advantageous if the work station is shut down in a controlled manner or can be shut down in a controlled manner. For this purpose, the work elements of the work station can be slowed down up to a standstill in a manner that is controlled and coordinated with each other, such that the thread end ultimately remains in the defined receiving position and does not wind on the bobbin. In doing so, possible waiting times on the thread seeking device are shortened even further, since it is only necessary in the event of unplanned interruptions in production, upon which the thread end winds on the bobbin.

It is advantageous if, upon moving into the receiving position, the thread seeking device moves the thread end into the effective area of a pneumatic work element, in particular a pneumatic handling element, of the work station. Such a pneumatic handling element is usually provided at the work stations in any event, in order to fix the thread end upon the piecing process or to form a thread reserve. However, an additional pneumatic handling element for acquiring the thread end by the thread seeking device can be provided. It is also possible that the thread end is directly received by a pneumatic work element of the work station, with a spinning machine, for example, the spinning device. In the case of a rotor spinning machine, the thread end can be received, for example through the draw-off nozzle of the rotor spinning device or, in the case of an air jet spinning machine, through the air jet spinning nozzle. In any case, the thread end can thus be very quickly transferred through the thread seeking device to the work station, such that waiting times can be further reduced.

It is also advantageous if, upon moving into the receiving position, the thread seeking device inserts the thread end at the same time into the draw-off device of the work station and/or into a thread guide of the winding device and/or into a yarn monitoring device. Thus, the thread end is moved directly by the thread seeking device into a position in the thread path in which it would be located even after a controlled shutdown of the work station. Thus, additional handling facilities at the work station are not necessary. However, in principle, it is also conceivable that, in the receiving position, the thread end is transferred through the thread seeking device solely to a pneumatic handling element, and from there is inserted by additional handling elements of their own work station into the draw-off device and/or into the thread guide and/or into the yarn monitoring device.

With a particularly advantageous embodiment of the textile machine, the thread seeking device is movable in a longitudinal direction of the textile machine along multiple work stations arranged next to each other. Herein, it is in turn advantageous if the thread seeking device is movable by its own travel drive. However, it is also conceivable to arrange a drive for the thread seeking device on the textile machine and to connect the thread seeking device to the drive by means of a coupling element, for example a belt drive. Such a movable thread seeking device can be designed in a particularly space-saving manner, such that the arrangement of the work elements of the work station is thereby structurally more simple.

If the textile machine is provided as a double-sided textile machine, such a thread seeking device movable in a longitudinal direction of the textile machine can be designed in a simple and space-saving manner, if this is centrally movable between two longitudinal sides of the textile machine. The thread seeking device may herein include, for each of the two longitudinal sides, separate work elements, thus one suction nozzle each and, if applicable, one transfer element each. Alternatively, for both longitudinal sides of the textile machine, a common suction nozzle can be provided, which can be delivered to the two longitudinal sides or their work stations in exchange. For this purpose, the common suction nozzle and, if applicable, a common transfer element can be arranged on a movable frame in a manner that is, for example, able to be swiveled or folded on both longitudinal sides.

According to an additional advantageous form, the thread seeking device is arranged between at least two work stations of the textile machine in a manner such that it can be moved back and forth on the textile machine. For example, a thread seeking device may be arranged between two work stations that are next to each other in a longitudinal direction, and can be swiveled back and forth between these. In addition, the thread seeking device may also be foldable and/or (if applicable) telescopic in such a manner that, for example, four work stations located next to each other can be operated.

According to an advantageous design of the textile machine, the handling elements of the individual work stations further comprise at least one thread separating unit for cutting the thread end to length, one thread preparing unit for preparing the pre-cut thread end and one feedback unit for returning the prepared thread end to the spinning unit and/or to a connection point. In the case of a winding machine, the connection point is located in the area of a splicer. In the case of a spinning machine, this may also be located outside of the spinning unit. Herein, the feedback unit may be both designed by an additional device, such as a pair of auxiliary rollers, or formed by the regular draw-off device.

BRIEF DESCRIPTION OF THE DRAWINGS

Additional advantages of the invention are described on the basis of the following presented embodiments. The following is shown.

DETAILED DESCRIPTION

Figure 1:
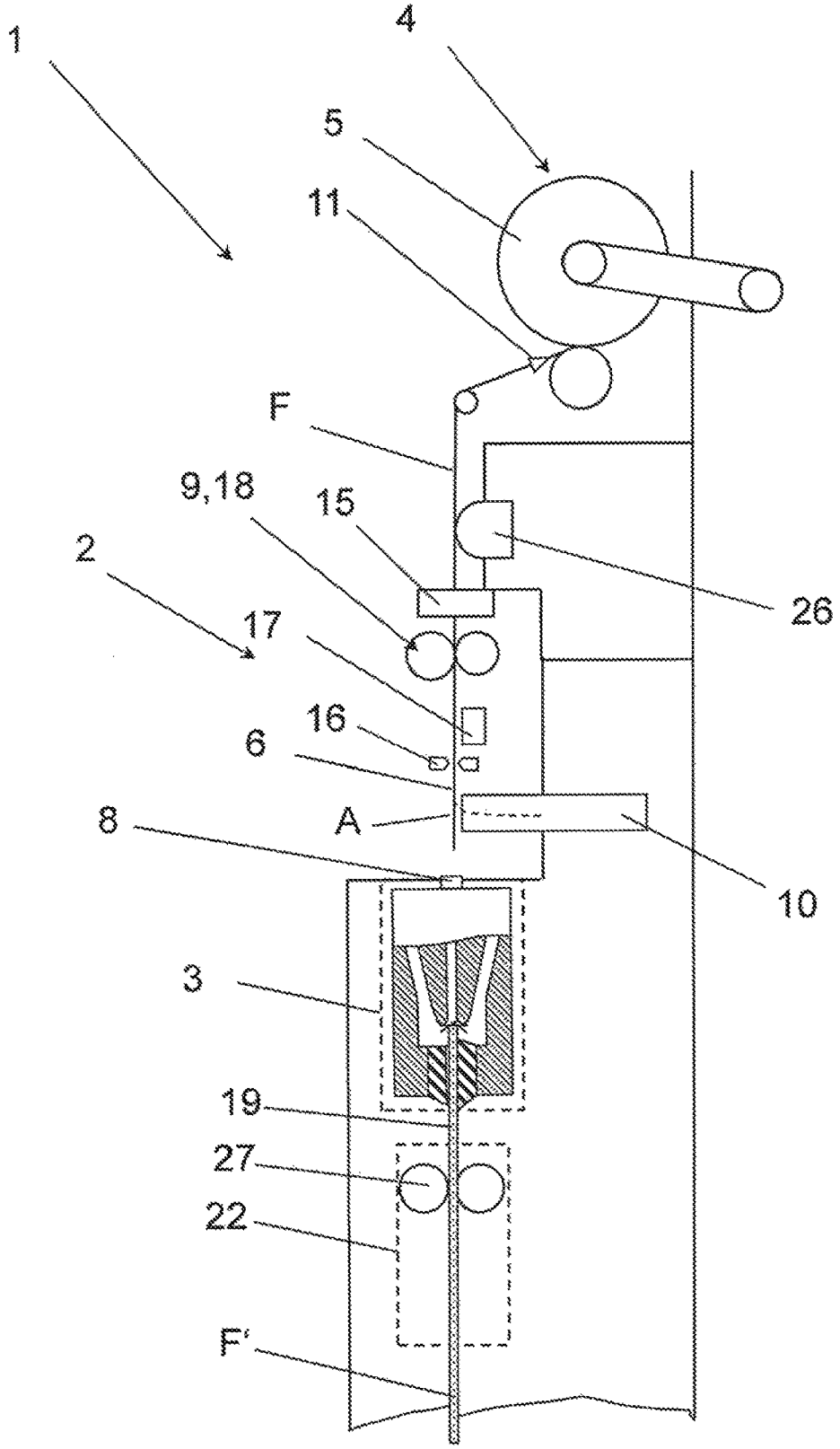
FIG. 1 is a spinning machine in a first design as an air jet spinning machine, in a schematic overview.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a spinning machine 1 in a first design as an air jet spinning machine in a schematic overview. The spinning machine 1 includes, in a conventional manner, a multiple number of work stations 2 arranged next to each other, each of which features a drafting system 22 with a pair of delivery rollers 27, a spinning unit 3 with a spinning device, here in the form of an air jet spinning nozzle, a draw-off device 9, and a winding device 4 with a traversing device (not shown) and a thread guide 11. A fiber material F' is fed to the drafting system 22; this is drafted in the drafting system 22 and fed through the delivery rollers 27 to the spinning unit 3 with the air jet spinning nozzle. The thread F produced there is drawn off from the spinning unit 3 by means of a draw-off device 9 and, according to the present illustration, is fed through a yarn monitoring device 15 and a waxing device 26 to the winding device 4, where it is wound onto a bobbin 5.

Furthermore, a series of handling elements 10, 16, 17, 18 is provided at each work station 2, by means of which, after an interruption of production, here the spinning process, a thread end 6 on the bobbin side can be pieced up. For this purpose, the thread end 6 is cut to length by a thread separating unit 16, prepared for piecing by a thread preparing unit 17, and returned through a feedback unit 18 into the spinning unit, or through the spinning unit 3 through a connection point 19 outside of the spinning unit 3. In the present case, the feedback unit 18 is formed by the draw-off device 9 of the work station, which is driven to return the thread end 6 counter to the regular draw-off direction.

However, the feedback unit 18 may be designed as a separate unit, for example as a pair of auxiliary rollers.

In the present case, a pneumatic handling element 10 is arranged at the work station 2 to temporarily fix the thread end 6. However, this is not absolutely necessary. Depending on the arrangement of the individual components and the handling elements 16, 17, 18 at the work station 2, it is also possible to fix the thread end 6 by means of the draw-off device 9. Furthermore, a pneumatic handling element 10 for fixing the thread end 6 or for forming a thread reserve upon piecing can also be provided in another place within the thread path at the work station 2, or a multiple number of pneumatic handling elements 10 may be present. Finally, by way of deviation from the illustration shown, it is also possible that handling elements 10, 16, 17, 18 are not arranged at each work station 2; rather, such handling elements 10, 16, 17, 18 may be provided, for example, for two adjacent work stations 2.

The present illustration now shows a situation at the work station 2 after a targeted disruption of the spinning process. Such a controlled shutdown may occur at any predictable spin stop, for example, to remove a yarn defect, to change the bobbin or to switch off the work station 2 or the spinning machine. For this purpose, the conveying speeds of the individual work elements 27, 9, 4 of the work station 2, here at least the delivery rollers 27, the draw-off device 9, and the winding device 4 are reduced to a standstill in a manner that is gradual and coordinated with each other. For this purpose, the drives of the individual work elements 27, 9, 4 are equipped with individually controllable drive units (not shown), which are accordingly controllable by a control device (not shown) of the work station 2 or the spinning machine 1. Herein, the thread end 6 does not wind on the bobbin, but is located in a defined receiving position A between an output 8 of the spinning unit 3 and the winding device 4. From there, it can be easily received and pieced up by the handling elements 10, 16, 17, 18 of the work station 2. Since the thread end 6 on the bobbin side herein essentially remains in its regular thread path, after piecing, it no longer needs to be inserted at the work elements of the work station 2, in particular the draw-off device 9, the yarn monitoring device 15 and the thread guide 11. In the present case, the receiving position A is located between the output 8 of the spinning unit 3 and the draw-off device 9. The thread seeking device of the present invention, in particular a movable thread seeking device for a multiple number of work stations, may be particularly advantageously deployed on a spinning machine, the work stations of which can be shut down in a controlled manner. With such machines, the thread seeking device is required only in the event of unplanned interruptions of the spinning process, such that only a few, or even only one, thread seeking device is to be provided for each spinning machine. However, a thread seeking device movable between multiple work stations is also advantageous at conventional work stations without the possibility of the controlled shutdown.

Figure 2:
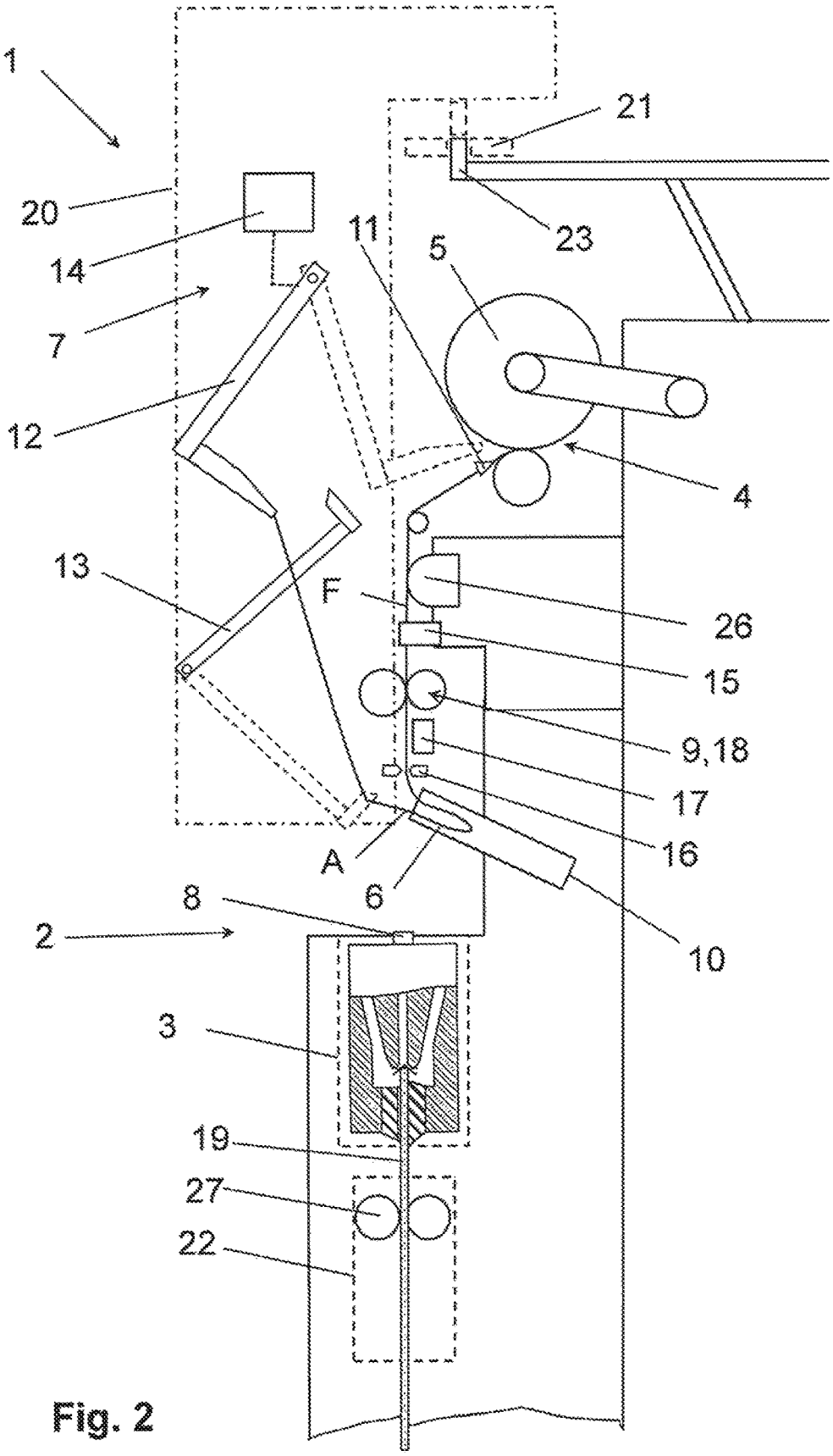
FIG. 2 is a textile machine designed as an air jet spinning machine with a movable thread seeking device, in a schematic overview.

FIG. 2 shows a first design of a spinning machine 1, which, just like the spinning machine 1 of FIG. 1, is designed as an air jet spinning machine. In the structure of its work stations 2, the spinning machine of FIG. 2 substantially corresponds to that described in FIG. 1, such that they are not further described. In addition, the spinning machine 1 shown in FIG. 2 features a thread seeking device 7, which in the present case features a suction nozzle 12 and a transfer element 13. The thread seeking device 7 also has a frame 20 and a chassis 21, by means of which they can be moved along the work stations 2 on running rails 23 of the spinning machine 1.

If an unforeseen interruption in the spinning process now arises, for example because of a thread breakage, the thread end 6 on the bobbin side winds on the surface of the bobbin 5. In this case as well, the movable thread seeking device 7 is provided in order to enable a resumption of the spinning process. The thread seeking device 7 may be positioned at the respective work station 2 and seek out the thread end 6 on the bobbin 5 by means of the movable suction nozzle 12. For this purpose, the bobbin 5 is driven opposite to its regular direction of rotation by a drive (not shown) at the work station 2, such that the thread end 6 can be sucked into the suction nozzle 12. After the successful receiving of the thread end 6 in the suction nozzle 12, which can be detected by a sensor, the thread end 6 is received from the suction nozzle 12 by the transfer element 13, and is transferred to the pneumatic handling element 10 of the work station 2 in the form of a thread loop. The thread end 6 is now present in the defined receiving position A.

Upon the movement of the thread end 6 into the receiving position A, the thread end 6 is herein simultaneously inserted into the work elements of the spinning unit, in the present case at least the yarn monitoring device 15 and the draw-off device 9, such that the thread end 6, just like that described in FIG. 1, can be pieced up by the work station handling elements 10, 16, 17, 18. If applicable, the thread end 6 may also be simultaneously inserted into the thread guide 11. However, this is not mandatory; the thread F may also be initially stored outside of the thread guide 11, and re-inserted into it only after a successful piecing. In FIG. 2, a situation is shown in which the thread end already has been found on the bobbin 5, and is inserted by the transfer element 13 into the draw-off device 9 and the yarn monitoring unit 15, and is transferred to the pneumatic handling element 10 in the form of the thread loop.

Given the fact that, in the present case, the thread seeking device 7 must, with respect to the setting process, carry out exclusively the two functions of thread seeking and thread transfer, while the handling elements for piecing 10, 16, 17, 18 are found at the work station 2, the thread seeking device 7 may be carried out with a highly simple design and may be produced cost-effectively. According to an additional design, the thread seeking device 7 may also carry out a cutting operation, whereas, however, the thread seeking device 7 may still be designed very simply and cost-effectively. In addition, after the transfer of the thread end 6, the thread seeking device 7 immediately seeks out the next work station 2 at which a thread breakage has arisen. Since, in addition, the thread seeking device 7 is necessary solely in the event of an unforeseen, comparatively rare thread breakage, but not for predictable interruptions in the spinning operation, waiting times at the work stations 2 with corresponding production losses can almost be completely avoided.

In the present case, the suction nozzle 12 is designed to have a swiveling motion and for this purpose features a drive 14. However, the suction nozzle 12 may also be designed to be linearly movable or deliverable in another manner to the bobbin 5. It is also not absolutely necessary to provide a separate transfer element 13. Depending on the design and movability of the suction nozzle, the thread end 6 may be moved directly by the suction nozzle 12 into the receiving position A at the work station 2. It is also conceivable to arrange a multiple number of transfer elements 13 in the thread seeking device 7, in order to insert the thread F in the work elements of the spinning machine, in particular the draw-off device 9, the yarn monitoring device 15 and the thread guide 11, and to transfer it to the handling elements 10, 16, 17, 18. Finally, by way of deviation from the illustration shown here, a cutting device for the thread may be provided on the thread seeking device 7.

Figure 3:
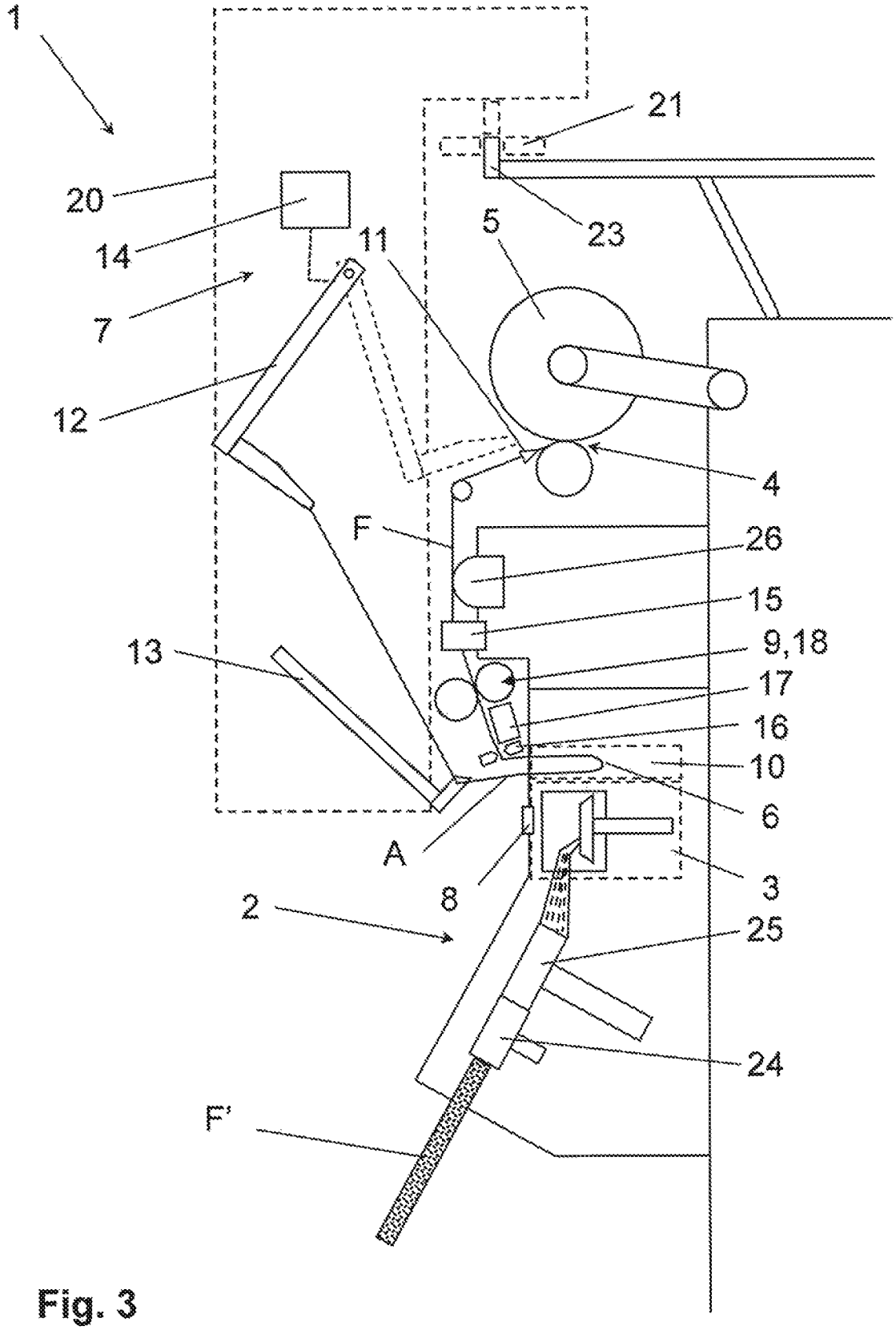
FIG. 3 is a textile machine designed as rotor spinning machine with a movable thread seeking device, in a schematic overview.

Finally, FIG. 3 shows an additional design of a spinning machine 1, which is designed in the form of a rotor spinning machine. The structure of the spinning machine 1 essentially corresponds to that of the spinning machine 1 of FIG. 2. In the following, only the differences with FIG. 2 will be described.

Each work station 2 of the spinning machine 1 of FIG. 3 includes a spinning unit 3 with a spinning device 28, which is designed in the form of a rotor spinning device, a feed device 24 and an opening device 25, through which a fiber material F' may be fed to the spinning unit 3. The thread F spun in the spinning unit 3 is in turn drawn off by a draw-off device 9, a yarn monitoring device 15 and a waxing device 26, and is wound by the winding device 4 through a thread guide 11 onto a bobbin 5. Likewise, as handling elements of the work station 2, a pneumatic handling element 10, a yarn separating device 16, a thread preparing unit 17 and a feedback unit 18, which is also formed by the draw-off device 9, are provided. For a controlled shutdown of a work station 2 in the case of a predictable spin stop, the conveying speeds of the work elements of the work station 2, in particular the feed device 24, the opening device 25, the draw-off device 9 and the winding device 4, can be reduced to a standstill in a manner that is defined and coordinated with each other, such that the thread end 6 does not wind on the bobbin 5, but is found at a defined receiving position A. However, this is not required.

Moreover, in its structure and function, the thread seeking device 7 corresponds to the thread seeking device 7 of FIG. 2, such that reference is made to the description of FIG. 2.

In the present case, a situation in turn is presented in which a thread end 6 wound on the bobbin 5 has already been received by the suction nozzle 12 and has been moved by the transfer element 13 into the defined receiving position A, in which it now is in the form of a thread loop. The thread end 6 is received and fixed in the receiving position A in the handling element 10. As the yarn is now present in the defined receiving position, in turn, as with piecing, it may be cut to length by the thread separating unit 16 after a controlled shut down, prepared for piecing by the thread preparing unit 17 and returned to it by the feedback unit 18 through the output 8 of the spinning unit 3.

The described thread seeking device 7 may be used in various textile machines, such as winding machines, air jet spinning machines or rotor spinning machines. Since the thread seeking device 7 is used only briefly for thread seeking and thread transfer to a work station 2, while all time-consuming work of the piecing process, in particular the cutting and preparation of the thread end 6, can be carried out directly by the work station 2, a significant time advantage compared to a conventional maintenance device arises. After the thread transfer into the receiving position has taken place, the thread seeking device 7 immediately seeks out the next work station, such that waiting times with corresponding production losses can be avoided. In the case of a work station that can be shut down in a controlled manner, the fact that predictable interruptions of the spinning process can be processed without the thread seeking device 7 contributes to avoiding waiting times, such that this must be used only in the relatively few cases of unforeseeable thread breakages. Since the movable thread seeking device 7 may operate a multiple number of work stations 2 in a short time after one another, it is not necessary to arrange a cost-intensive thread seeking device with a high need for space at each of the work stations 2. It is also advantageous that the number of the thread seeking devices 7 at a textile machine can be adapted without any problems for different machines lengths or different numbers of work stations 2 or for the expected fiber breakage rate. The proposed thread seeking device 7 may also be produced very cost-effectively, since, in addition to its basic components such as the frame 20, the chassis 21, and devices for supplying power and control, it features as work elements only one suction nozzle 12 and one or more transfer elements 13.

Modifications and variations can be made to the embodiments illustrated or described herein without departing from the scope and spirit of the invention as set forth in the appended claims.

LIST OF REFERENCE SIGNS

1 Spinning machine
2 Work station
3 Spinning unit
4 Winding device
5 Bobbin
6 Thread end
7 Thread seeking device
8 Output of the spinning unit
9 Draw-off device
10 Pneumatic handling element of the work station
11 Thread guide
12 Suction nozzle
13 Transfer element
14 Drive of the suction nozzle
15 Yarn monitoring device
16 Thread separating unit
17 Thread preparing unit
18 Feedback unit
19 Connection point
20 Frame
21 Chassis
22 Drafting system
23 Running rail
24 Feed device
25 Opening device
26 Waxing device
27 Delivery rollers
F Thread
F' Fiber material
A Receiving position

The invention claimed is:

1. A method for operating a textile spinning machine having a multiple number of work stations arranged next to each other in a longitudinal direction of the textile machine, wherein each work station includes a spinning unit with a spinning device for producing a thread and a winding device for winding a thread onto a bobbin and respective handling elements at each work station for piecing the thread or for connecting two thread ends, the method comprising:

upon a predictable interruption of thread production at a work station, a thread end of the thread wound on the bobbin is at a defined receiving position at the work station without being unwound from the bobbin;

cutting the thread end that is at the receiving position with work station handling elements and then preparing for piecing the thread or for connecting two thread ends at the work station with the work station handling elements; and wherein at the defined receiving position, the thread end is received by a handling element for piecing.

2. The method according to claim 1, wherein the receiving position is located in a thread path between an output of the spinning unit and the winding device.

3. The method according to claim 1, wherein the work station is shut down in a controlled manner prior to the predictable interruption of thread production.

4. The method according to claim 1, at the defined receiving position, the thread end is brought into an effective area of a pneumatic handling element of the work station.

5. The method according to claim 1, wherein the handling element is one or more of a draw-off device, a thread guide, or a yarn monitoring device of the work station.

6. A textile spinning machine, comprising:

a multiple number of work stations arranged next to each other in a longitudinal direction of the textile machine;

each work station comprising one or both of a spinning unit with a spinning device that produces a thread, and a winding device that winds the thread onto a bobbin;

handling elements configured to prepare a thread end received at a receiving position at the work station for subsequent piecing or connection with another thread end at the work station; and wherein the textile spinning machine is configured to operate in accordance with the method of claim 1 such that upon a predictable interruption of thread production at a work station, a thread end of the thread wound on the bobbin is at a defined receiving position at the work station without being unwound from the bobbin;

the thread, end is cut at the receiving position with the work station handling elements and then prepared for piercing the thread or for connecting two thread ends at the work station with the work station handling elements; and wherein at the defined receiving position, the thread end is received by a handling element for piecing.

7. The textile machine according to claim 6, wherein the receiving position is located in a thread path at the work station between an output of the spinning unit and the winding device.

8. The textile machine according to claim 6, wherein the handling element comprises a pneumatic handling element disposed to receive the thread end at the receiving position.

9. The textile machine according to claim 6, wherein the handling elements at each work station comprise a thread separating unit to cut the thread end to length, a thread preparing unit to prepare the pre-cut thread end, and a feedback unit to return the prepared thread end to the spinning unit or to a connection point for connection to the other thread end at the work station.

* * * * *